United States Patent [19]

Billner et al.

[11] 4,391,089

[45] Jul. 5, 1983

[54] APPARATUS FOR PIECING-UP A WRAP YARN

[75] Inventors: Werner Billner; Erich Bock, both of Ingolstadt, Fed. Rep. of Germany

[73] Assignee: Schubert & Salzer, Ingolstadt, Fed. Rep. of Germany

[21] Appl. No.: 266,588

[22] Filed: May 22, 1981

[30] Foreign Application Priority Data

May 31, 1980 [DE] Fed. Rep. of Germany ..... 3020726

[51] Int. Cl.[3] ..... D01H 15/00; D02G 3/36

[52] U.S. Cl. ..... 57/261; 57/18; 57/279

[58] Field of Search ..... 57/16–18, 57/261, 279, 280

[56] References Cited

U.S. PATENT DOCUMENTS 3,328,946 7/1967 Schumann et al. ..... 57/18
4,080,779 3/1978 Freeman et al. ..... 57/18 X
4,170,101 10/1979 Bock ..... 57/261 X
4,299,083 11/1981 Igel et al. ..... 57/18
4,336,683 6/1982 Bock et al. ..... 57/18

*Primary Examiner*—John Petrakes
*Attorney, Agent, or Firm*—Julian W. Dority

[57] ABSTRACT

An apparatus for aiding in piecing-up wrapped yarn on a yarn wrapping device which includes a hollow spindle upon which a bobbin of wrapping thread is carried. A pair of delivery rolls feeds a fiber bundle F through a fiber feed channel 8 provided in a pot carried on top of a housing which encloses the hollow spindle and bobbin. Holes 73 are provided in the downwardly extending projections of the pot so that in normal operation air flows through the housing and out of the holes 73. However, upon piecing-up of the yarn, the pot is depressed closing the holes 73 and 61 allowing the air flow to flow at its maximum through the feed channel out of a suction duct 9. This increased suction through suction duct 9 causes the fiber bundle F, the wrapping yarn B, and wrapped yarn G to be sucked thereinto for being pieced-up.

6 Claims, 3 Drawing Figures

FIG.1
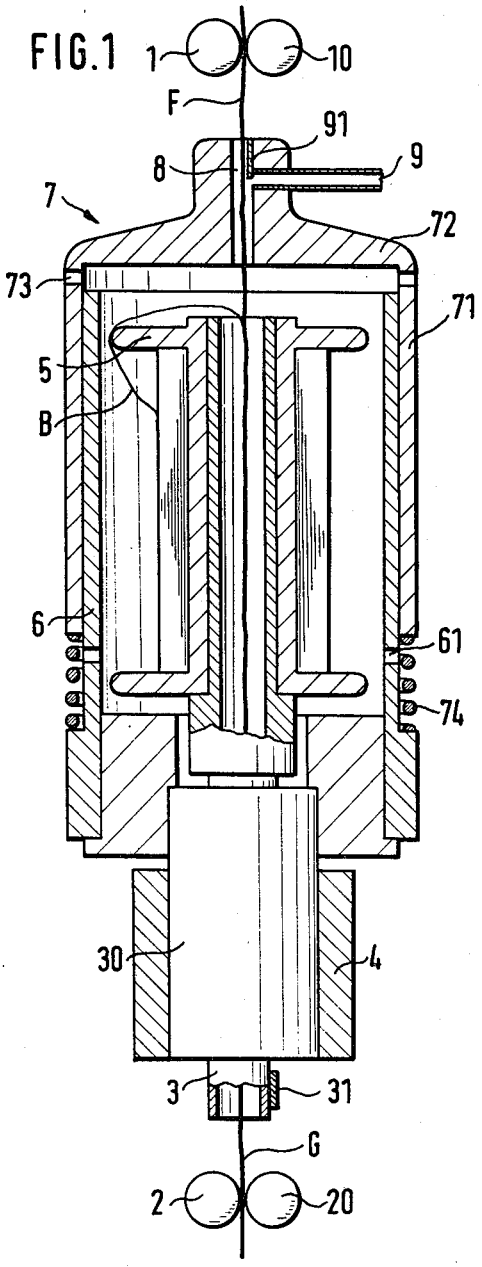
FIG.3
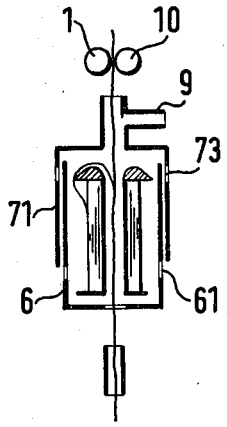
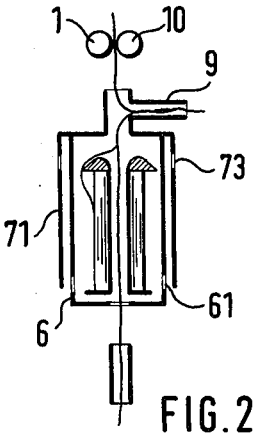
FIG.2

APPARATUS FOR PIECING-UP A WRAP YARN

BACKGROUND OF THE INVENTION

The invention relates to an apparatus for piecing-up a wrap yarn being produced with a hollow spindle carrying a bobbin with a wrapping thread and arranged between a pair of delivery rolls and a pair of takeoff rolls. A housing concentrically surrounds the bobbin with its wall having openings for the passage of air. A suction duct is arranged between the pair of delivery rolls and the hollow spindle.

For piecing-up, it is known in an apparatus of the above-mentioned kind to deflect a spinning fiber bundle emerging from the pair of delivery rolls by means of a suction air stream produced by a suction apparatus into the suction duct where it is entrained by the suction air after the hollow spindle is stopped. The fiber bundle is united with the wrapping thread delivered back through the hollow spindle with the wrapping thread, and twisted with these by starting the hollow spindle (DE-OS No. 2,753,349). The openings in the jacket of the housing surrounding the bobbin through which air can flow enables an air vortex to be produced within the housing which automatically results in the exposing of a broken wrapping thread on the spindle.

It has been found to be disadvantageous in the known piecing-up process that because of the air passage openings in the housing a suction apparatus with a high suction power is required in order to produce in the hollow spindle a strong enough suction to deliver the wrapping thread back into the suction duct. The efficiency of the piecing-up process is thereby reduced. This is even more the case if, on technological grounds for the spinning operation, further openings are provided in the housing. A further disadvantage consists in that because of the relatively large cross section of the suction duct for the required suction effect, the guiding of the spinning fiber bundle, together with the wrap yarn and the wrapping thread, is not always ensured.

SUMMARY OF THE INVENTION

The object of the present invention is to avoid these disadvantages and to provide an apparatus by means of which piecing-up is improved.

This object is achieved, according to the invention, in that a closing element is associated with the openings and can be brought into the closed position during piecing-up.

Hence, it is now possible to concentrate the suction air stream more strongly on the bore of the hollow spindle so that, even when a suction apparatus with a relatively small power is used, it satisfactorily draws the wrap yarn through the hollow spindle into the suction duct.

In an embodiment which is favorable for servicing, the closure element is a pot inverted over the housing, having a fiber feed channel which is in axial alignment with the longitudinal axis of the hollow spindle. The pot is displaceable during piecing-up in the direction of the pair of takeup rolls. A suction duct opens into the fiber feed channel.

As far as A defined air flow in the housing during operation which cools the system during use, its interruption during piecing-up is made possible by the presence of air flow opening in a portion of the pot projecting over the housing which also are closed by the housing on displacement of the pot. The pot is appropriately displaceable on the housing against the force of a spring. In order to achieve a more certain uniting of the fiber bundle, the wrap yarn, and the wrapping thread, the flow cross section of the suction duct is constricted at its opening into the fiber feed channel.

Accordingly, it is an important object of the present invention to provide an apparatus for controlling the flow of air through a yarn wrapping device so as to aid in piecing-up the yarn.

Another important object of the present invention is to provide a very simple and reliable apparatus for producing a controlled stream of air on a wrapping device to facilitate piecing-up yarn.

BRIEF DESCRIPTION OF THE DRAWINGS

FIG. 1 is a partial longitudinal sectional view illustrating a yarn wrapping apparatus constructed in accordance with the present invention.

FIGS. 2 and 3 are schematic views illustrating two alternate positions of a pot positioned on a housing.

DESCRIPTION OF A PREFERRED EMBODIMENT

The wrapping apparatus shown in FIG. 1 contains a pair of delivery rolls 1, 10 and a pair of takeoff rolls 2, 20 between which is arranged a hollow spindle 3. The hollow spindle 3 is rotatably mounted on the machine frame 4 by means of a spindle bearing 30 and is driven, for example, by a tangential belt 31. A bobbin 5 is placed on the hollow spindle 3 and contains a wrapping thread B. It is termed the wrapping thread bobbin. The bobbin 5, a flanged bobbin in the example of an embodiment, is connected positively to the hollow spindle to rotate with it, and is surrounded concentrically by a stationary housing 6 which is fastened to the spindle bearing 30 or can also be fastened to the machine frame 4. The jacket of the housing 6 has, in the neighborhood of the machine frame 4 or of the spindle bearing 30, perforations or openings 61 for the passage of air.

Associated with the openings 61 is a closing element 7 which is preferably constructed as a pot 71 inverted over the housing 6 and mounted on this for telescopic displacement. Thus, the main body 72 of the pot 71 which is spaced above the upper edge of the housing 6, closes the upper portion of the housing 6 which is open in the region of the inlet opening of the hollow spindle 3. A cylindrical projection of the main body 72 extends in the direction of the delivery roll pair 1, 10 and contains a fiber feed channel 8 for a fiber bundle F delivered by the delivery roll pair 1, 10. A suction duct 9 opens into the fiber feed channel 8 and is connected to a suction apparatus (not shown).

In the example of an embodiment, the jacket of the pot possesses additional openings 73 in a portion projecting over the housing 6, so that the course of an air stream arising on rotation of the hollow spindle 3 and of the bobbin 5 is defined through the housing substantially by the openings 61 and 73.

Such a defined air stream within the housing 6 has been found to be appropriate for cooling the system. With the use of a mushroom-shaped spindle cap as shown in FIGS. 2 and 3, it further serves to hold the wrapping thread in constant contact with the surface of the spindle cap.

In operation, the pot 71, which is supported, for example, on a shoulder of the housing 6 by a spring 74, is located in the position shown in FIG. 1, in which the openings 61 and 73 are free for passage of air. Of course, the pot 71 can be held in this position during spinning operation by other apparatus such as, for example, clamps. The fiber bundle F, supplied by the pair of delivery rolls 1, 10 through the fiber feed channel 8 into the hollow spindle 3, is wrapped when the hollow spindle 3 and the bobbin 5 which is fixed thereto is driven. The wrapping thread B is likewise introduced into the hollow spindle 3. The finished wrap yarn G is drawn off out of the hollow spindle 3 by means of the takeoff roll pair 2, 20.

For piecing-up, for example, after a break of the fiber bundle F, the wrapping apparatus is stopped. The suction air stream of the suction duct 9 now entrains the fiber bundle F when it is broken between the delivery roll pair and the wrapping point, and deflects it into the suction duct 9. If the break of the fiber bundle F has resulted from runout of roving upstream of the pair of delivery rolls, the supply of roving is first ensured, and the fiber bundle F emerging from the pair of delivery rolls is entrained by the suction air stream. If the wrapping thread B is not broken, it is now parted, for example, between the hollow spindle 3 and the pair of takeoff rolls 2, 20, and the openings 61 and 73 are closed by displacement of the pot 71. Because of the air stream now built up in the hollow spindle 3, the wrapping thread B now gets into the suction duct 9. The end of the wrap yarn G can likewise now be withdrawn from a thread bobbin and forwarded through the hollow spindle 3 into the suction duct 9.

As already mentioned above, for delivery of the wrap yarn G and the wrapping thread B back into the suction duct 9, the pot 71, arranged on the housing 6, is pushed in the direction of the pair of takeoff rolls 2, 20 against the force of the spring 74, until its openings 73 are closed by the jacket of the housing 6 and the openings 61 of the housing 6 are closed by the jacket of the pot 71, so that substantially outer air is sucked into the housing 6 only through the hollow spindle 3 and the fiber feed channel 8 (FIG. 2). The suction air stream is thus concentrated more strongly on the bore of the hollow spindle 3. It is thus possible, even when a suction apparatus of relatively low power is used, to forward the wrap yarn and the wrapping thread reliably into the suction duct, where these two components come into contact with the fiber bundle F and are twisted with it by the subsequent starting of the wrapping apparatus. The pot 71 is then brought back again into the position shown in FIG. 1.

The stronger concentration of the suction air stream within the hollow spindle 3 achieved by closing the openings 61 and 73 makes it possible to constrict the flow across section of the suction duct 9 at its opening into the fiber feed channel 8, for example, by a plate 91 partially covering the opening, without thereby endangering the satisfactory delivery of the wrap yarn back into the suction duct 9. This constriction by the plate 91, about which the fiber bundle F is deflected into the suction duct 9, ensures that the fiber bundle F always comes into contact with the wrap yarn G and the wrapping thread B and hence trouble-free uniting of these three components is guaranteed in every case.

If the spinning process has been interrupted by a break of the wrapping thread B, it is necessary after stopping the spindle to uncover the end of the binding thread contiguous to the turns on the bobbin 5; this is conveniently effected automatically by an air vortex. In this case, as a modification of the procedure described above, the pot 71 is first displaced only so far on the housing 6 in the direction of the pair of takeoff rolls so that only the openings 73 of the pot 71 are closed (FIG. 3). The air required for production of the air vortex can thus flow in unhindered through the openings 61 in the housing 6. When the wrapping thread B has been uncovered and drawn into the suction duct 9, the openings 61 of the housing 6 are also closed by further displacement of the pot 71 in the direction towards the takeoff roll pair 2, 20. An increased suction air stream is thus, as explained above, effective in the hollow spindle 3, and reliably takes over the forwarding of the wrap yarn G through the hollow spindle into the suction duct 9.

The apparatus as described can be modified. Thus, in appropriate circumstances, the additional openings 73 can, in given cases, be omitted. Instead of the pot 71, other closing elements; for example, flaps, can also be provided for closing the openings. In this case, the housing 6 is closed by a cover.

While a preferred embodiment of the invention has been described, such description is for illustrative purposes only, and it is to be understood that changes and variations may be made without departing from the spirit or scope of the following claims.

What is claimed is:

1. Apparatus for piecing-up a wrap yarn being produced from a bundle of spinning fibers and a wrapping thread on a wrapping device, a hollow spindle forming part of said wrapping device, a bobbin of said wrapping thread carried on said hollow spindle, a pair of delivery rolls for feeding said bundle of spinning fibers to said hollow spindle and a pair of takeup rolls for drawing off said wrap yarn out of said hollow spindle, a housing concentrically surrounding said bobbin, a jacket forming part of said housing having openings for the passage of air, and a suction duct arranged between said pair of delivery rolls and said hollow spindle comprising:

a closing element associated with said openings for selectively closing and opening during piecing-up of said yarn;

said closing element being a pot inverted over said housing, a fiber feed channel extending through said pot in axial alignment with said hollow spindle, said suction duct opening into said feed channel, and said pot being telescopically displaceable during piecing-up in the direction of said pair of takeoff rolls to an extent such that it covers said openings.

2. A method for piecing-up a wrap yarn being produced from a bundle of spinning fibers and a wrapping thread by means of a wrapping device comprising a hollow spindle carrying a bobbin of said wrapping thread and arranged between a pair of delivery rolls for feeding said bundle of spinning fibers to said hollow spindle and a pair of take-off rolls for drawing off said wrap yarn out of the hollow spindle, a housing concentrically surrounding said bobbin, a jacket forming part of said housing having openings for the passage of air, and a suction duct arranged between said pair of delivery rolls and said hollow spindle, comprising the following steps:

stopping said wrapping device;

producing an eddy of air in said housing by an airflow through said openings for seeking and exposure of a free end of said wrapping thread on said bobbin;

introducing an end of said wrap yarn withdrawn from a yarn bobbin into said hollow spindle, and producing a concentrated suction air stream in said housing by closing said openings for delivering back said ends of said wrap yarn and said wrapping thread into said suction duct.

3. A method as claimed in claim 2, further comprising:

holding open said openings during operation for producing an air stream in said housing for cooling.

4. Apparatus according to claim 1 further comprising:

said pot having a downwardly extending projection adjacent said housing;

an opening provided in said projection permitting air to flow from said housing and being closed upon displacement of said pot.

5. Apparatus according to claim 1 further comprising:

a spring carried by said housing and engaging said pot applying a force to said pot when said pot is displaced towards said pair of takeoff rolls.

6. Apparatus as set forth in claim 1 further comprising:

a constricting member in said suction duct at the junction of said fiber feed channel and said suction duct.

* * * * *